United States Patent [19]

Marinelli

[11] 4,333,247

[45] Jun. 8, 1982

[54] FOOTWEAR ARTICLE AND PROCESS

[75] Inventor: Lamberto Marinelli, Potro S. Elpidio, Italy

[73] Assignee: TAK PLAST Company, Italy

[21] Appl. No.: 967,027

[22] Filed: Dec. 6, 1978

[30] Foreign Application Priority Data

Dec. 14, 1977 [IT] Italy ..... 644 A/77
Mar. 2, 1978 [IT] Italy ..... 607 A/78

[51] Int. Cl.[3] ..... A43B 3/12; A43D 9/00
[52] U.S. Cl. ..... 36/11.5; 12/142 S
[58] Field of Search ..... 36/11.5, 59 R, 100, 36/101, 30 R; 12/142 R, 142 S

[56] References Cited

U.S. PATENT DOCUMENTS 2,092,533 9/1937 Hyde ..... 36/11.5
2,468,573 4/1949 Rimer ..... 36/11.5
3,494,055 2/1970 McSorley ..... 36/59 R
3,599,353 8/1971 Magidson ..... 36/11.5
3,925,914 12/1975 Marcoux ..... 36/11.5

FOREIGN PATENT DOCUMENTS 2223546 11/1973 Fed. Rep. of Germany ..... 36/11.5
2346370 3/1975 Fed. Rep. of Germany ..... 36/11.5
2226805 11/1974 France ..... 36/11.5

*Primary Examiner*—Patrick D. Lawson
*Attorney, Agent, or Firm*—Blair, Brown & Kreten

[57] ABSTRACT

An article of footwear and process for making same in which upper portions of a shoe are fastened to a synthetic sole by placing portions of the upper through slots on the outer periphery of the sole turning same under, and fastening same by coaction of an undersole to the sole; the uppers fastened by means of studs which traverse therethrough to blind holes disposed on opposed faces of the sole and undersole.

7 Claims, 3 Drawing Figures

FOOTWEAR ARTICLE AND PROCESS

BACKGROUND AND FIELD OF THE INVENTION

The invention relates to an industrial process for the attachment of the upper to the soles of the shoes.

Theoretically, as will be seen from the following description this process can be generally applied to any kind of footwear, but in practice it offers the best application in the production of sandals and clogs which are made entirely of polyurethane plastic.

In traditional methods the straps, which in this particular kind of footwear are fixed between the sole and shoe bottom, are usually glued or nailed together on the outside edge of the sole.

SUMMARY AND OBJECTS OF THE INVENTION

However, according to our invention the upper or the straps are inserted into appropriate slots along the edges of the sole and then folded and held firm by the polyurethan under-sole.

The following description together with the accompanying drawings of a sandal will disclose the way of carrying out this new industrial process; obviously this style of shoe is only indicative in that other models can be used.

DESCRIPTION OF THE PREFERRED EMBODIMENT

Figure 1:
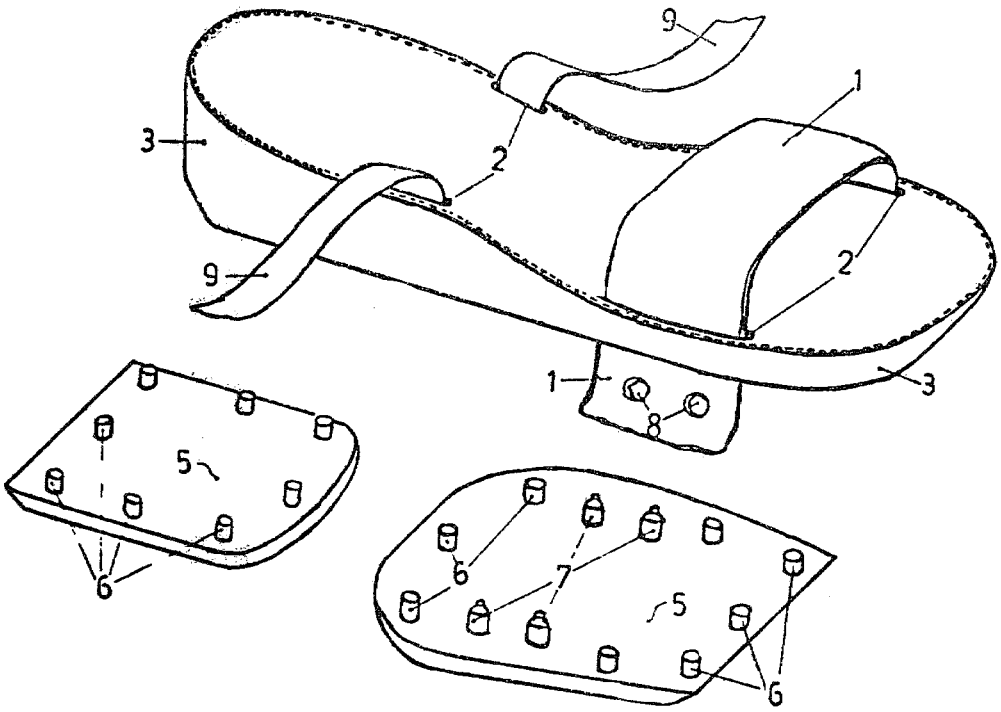
FIG. 1 illustrates the component parts of a sandal made according to the invention.
Figure 2:
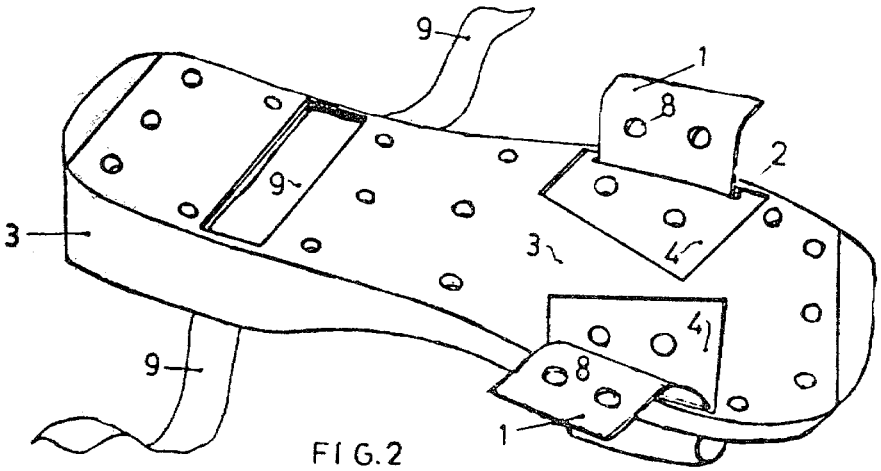
FIG. 2 illustrates the underside of the sole which is shaped and cut in such a way as to allow the assembly by pressure of the two under-soles as shown in FIG. 1.

Referring to the drawings, the process and articles formed consists of inserting the upper (1) in the lengthwise slots (2) made along the edges of the sole (3) under which the ends of the upper (1) are folded and then fitted into appropriate cut-outs (4).

Once the upper has been put into place the under-sole (5) can be applied. Its small studs (6) are inserted forcibly into corresponding blind holes made in the under surface of the sole (3).

The four studs (7) before going into their seats must first pass through the holes (8) made in the upper (1) which in this way is permanently and securely fitted into place.

The same applies to the strap or lace (9) which may be present and which can be inserted directly from underneath, in that its ends will be tied or buckled over the foot.

Clearly, in view of what has been described above the process is more effective when used for the production of footwear made of polyurethane plastic.

In fact in this specific case, the sole (3) and under-sole (5) are made by plastic moulding which allows the manufacture of one piece units having all the required studs or holes and pattern.

Figure 3:
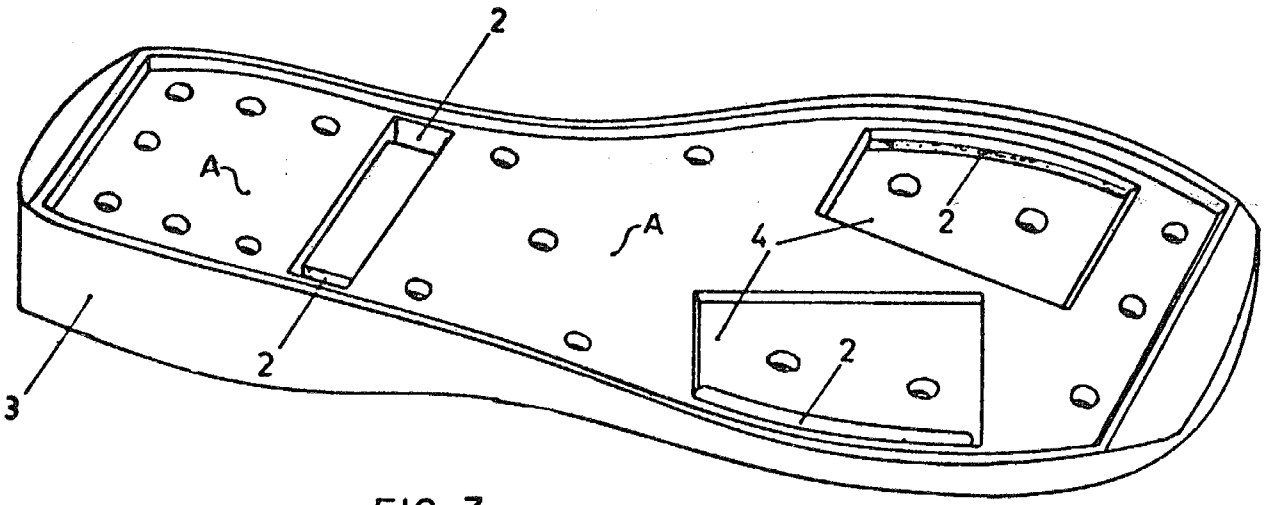
FIG. 3 shows the underside of a second sole according to this invention.

Since like numerals refer to like parts, FIG. 3 illustrates the underside of a second sole which has been purposely made with a recessed hollow area ("A") to enable the identically shaped under-soles (5) to be partially inserted.

In this way the under-sole is strengthened and anchored more stably to the sole (3) eliminating the possibility of fine foreign bodies wedging themselves between the sole and under-sole, even causing them to sometimes come apart because of the peripheral rim surrounding the recessed hollow area ("A").

According to this second preferred embodiment of the invention the two under-soles (5) can be joined together by a thin layer of rubber which is fitted right into the sole at points ("A") thus becoming invisible to the eye.

Thanks to this new process there is the elimination of sticking or fixing together by nails or clips of the upper to the sole thus giving an increased level of productivity with a notable saving of time and labor.

As already stated the sandal illustrated is only one of the many types of footwear to which this industrial process can be applied; a process which is undoubtedly new and which makes a completely original product.

Having thus described the preferred embodiment of the invention it should be understood that numerous structural modifications and adaptations may be resorted to without departing from the spirit of the invention.

What is claimed is:

1. An article of footwear comprising a sole having top and bottom faces, at least two slots disposed on opposed sides of said sole extending through the top and bottom faces, at least two cut out areas on the bottom face of the sole proximate to said slots, an upper having portions adapted to be threaded through said slots and folded onto said cut out areas, an undersole, and means to connect said undersole to said sole with said portions of said upper securely clamped therebetween. In which the said two slots are disposed near a front toe area of said sole, and two additional slots are provided near the rear heel area of said sole, a cutaway area extending between said last two additional slots on the bottom face of said sole, and a strap threaded through said two additional slots and running along said last named cutaway area.

2. The article of claim 1 in which a peripheral rim is disposed around the bottom face of said sole and said undersole nests within said rim.

3. The article of claim 2 in which said undersole is of two pieces.

4. The article of claim 1 in which said means to connect said undersole to said sole comprises studs disposed on said undersole and holes to register therewith disposed on said sole, some of said studs passing through the folded portions of said upper for retention.

5. A method for making footwear the steps comprising: forming a sole of plastic material, providing said sole with at least two slots on opposed sides of said sole near one end thereof threading end portions of an upper through said slots and folding these portions onto a bottom face of said sole, said end portions provided with holes, providing an undersole with studs and the bottom face of said sole with openings in registry with the studs and fastening said undersole to said sole, thereby fastening said upper end portions therebetween.

6. The method of claim 5 further including providing a second pair of slots on the sole at the end remote from said first two slots, providing a cutaway on the bottom face extending between said second pair of slots, and threading a strap through said slots upon said cutaway portion.

7. The method of claim 6 further providing a peripheral lip on the bottom face of said sole.

* * * * *